United States Patent [19]

Phillips

[11] 4,077,660

[45] Mar. 7, 1978

[54] SLING

[76] Inventor: William H. Phillips, Rte. No. 2, Carthage, Tex. 75633

[21] Appl. No.: 739,444

[22] Filed: Nov. 8, 1976

[51] Int. Cl.[2] ..... B66C 1/14

[52] U.S. Cl. ..... 294/75; 294/83 R

[58] Field of Search ..... 294/74–77, 294/78 R, 83 R, 84; 9/43, 44, 45; 24/115 R, 115 F, 230.5 AC, 230.5 CR, 230.5 CS, 241 TC, 242; 212/45, 82, 85

[56] References Cited

U.S. PATENT DOCUMENTS

| | | | |
|---|---|---|---|
| 91,488 | 6/1869 | Reyerson | 294/84 |
| 845,693 | 2/1907 | Coats et al. | 294/83 R |
| 1,228,494 | 6/1917 | Stewart | 294/75 |
| 1,862,312 | 6/1932 | Kositzky | 294/75 |
| 2,568,820 | 9/1951 | Osika | 294/83 R |
| 2,793,903 | 5/1957 | Mallard | 294/77 X |
| 2,829,916 | 4/1958 | Morales | 294/75 |

*Primary Examiner*—Johnny D. Cherry
*Attorney, Agent, or Firm*—Jack W. Hayden

[57] ABSTRACT

A sling for holding an object includes a support member with a rotatable member carried by and rotatable relative to the support member. The rotatable member has first and second ends which extend laterally from the support member with a flexible support for looping about the object to be held having one end secured to the first end of the rotatable member and a second end for releasably engaging with the second end of the rotatable member. The second end of the rotatable member is configured to retain the second end of the flexible support engaged therewith when the rotatable member is in one position while the flexible support holds the object and to release the second end of the flexible support when the rotatable member is rotated to a second position. Actuating means are associated with the rotatable member for rotation of the rotatable member to the one position to hold the object with the flexible support and for rotation of the rotatable member to the second position for disengagement of the second end of the flexible support from the second end of the rotatable member to release the sling from the object.

3 Claims, 9 Drawing Figures

SLING

SUMMARY OF THE INVENTION

The prior art with which applicant is familiar is U.S. Pat. Nos. 3,069,738 and 3,129,031.

Various devices have been proposed and are in use for holding or supporting objects during transport thereof from one location to another. For example, in shifting pipe joints or sections from a pipe rack to the floor of a drilling rig to connect the sections of pipe into a tubular string, or in shifting pipe from the rig to the pipe rack a device such as a pipe pickup and laydown machine as described in U.S. Letters Pat. No. 3,825,129, or in my copending patent application Ser. No. 659,478, filed on Feb. 19, 1976 may be employed.

My prior copending application Ser. No. 659,478 for "Pipe Laydown Machine" filed Feb. 19, 1976 illustrates several forms of slings suitable for use with tubular objects such as pipe to be moved from the pipe rack to the rig floor or from the rig floor to the pipe rack, and the present invention constitutes an improvement thereover.

An object of the present invention is to provide a sling for an object such as a pipe or the like which may be quickly and easily positioned about the pipe and readily disengaged therefrom.

Yet a further object of the present invention is to provide a sling for an object such as a pipe or the like which may be engaged therewith and which is constructed and arranged to retain its engaged relation with the object being held until it is desired to release the sling from the pipe, and which includes an arrangement that easily actuates to enable the sling to either automatically release or manually be released from the object such as the pipe when desired.

Yet a further object of the invention is to provide a sling for an object such as a pipe or the like which is self locking in that it latches itself in engagement with the pipe so long as the pipe or object is held, and which is constructed and arranged so that it rotates about its axis and automatically self releases from the pipe or object when the pipe or object is no longer held.

Still another object of the present invention is to provide a sling for holding an object including a support member with a rotatable member carried thereby and rotatable relative to the support member. The rotatable member is provided with first and second ends which extend laterally from the support means with a flexible support means that is adapted to be looped about the pipe or object to be held and has one end secured to an end of the rotatable member and a second end for engaging with another end of the rotatable member. The other end of the rotatable member is configured for releasably retaining the second end of the flexible means engaged therewith when the rotatable member is in one position while the flexible support means holds the object, and actuating means are associated with the rotatable member for rotation of the rotatable member to a second position which effects disengagement of the second end of the flexible support means from the other end of said rotatable member to release the sling from the object when the flexible line no longer holds the object.

Still another object of the present invention is to provide a support member having a base with extensions formed thereon and projecting longitudinally therefrom to provide a space therebetween, shaft means rotatably carried by and extending through the extensions with the shaft means having one end projecting from one of the extensions and another end projecting from the other extension. Flexible support means are provided for looping about the object to be held and having one end secured to the one end of the shaft means and a second end for releasably engaging with the second end of the shaft means. The second end of the shaft end includes a hook to aid in inhibiting premature release of the second end of the flexible support means engaged therewith when the flexible support means engages the object to hold it. Handle or actuating means are secured to the shaft means which may be manually grasped to rotate the shaft means and engage the hook with the second end of the flexible support means; such rotation engages restraining means to inhibit premature release of the flexible support means from the object. The handle means also effects rotation of the shaft means for release of the flexible support means from second end of said shaft means.

Still another object of the present invention is to provide a support member having a base with extensions formed thereon and projecting longitudinally therefrom to provide a space therebetween, shaft means rotatably carried by and extending through the extensions with the shaft means having one end projecting from one of the extensions and another end projecting from the other extension. Flexible support means are provided for looping about the object to be held and having one end secured to the one end of the shaft means and a second end for releasably engaging with the second end of the shaft means. The second end of the shaft end includes a hook to aid in inhibiting premature release of the second end of the flexible support means engaged therewith when the flexible support means engages the object to hold it. Handle or actuating means are secured to the shaft means which may be manually grasped to rotate the shaft means and engage the hook with the second end of the flexible support means; such rotation engages restraining means to inhibit premature release of the flexible support means from the object. The handle means also effects rotation of the shaft means for release of the flexible support means from said second end of said shaft means. Stop means are positioned in the space between the extensions, and the handle means is urged to abut against such stop means by the weight of the object held by the flexible support means.

BRIEF DESCRIPTION OF THE DRAWINGS

FIG. 9 is a sectional view similar to FIG. 5 and showing an alternate arrangement of engaging the actuating means and the rotatable shaft means.

DESCRIPTION OF THE PREFERRED EMBODIMENTS

The present invention will be described in detail in relation to its use with a pipe pickup and laydown machine; however, such is for explanation only and the present invention may be used wherever slings of such type have application.

Figure 2:
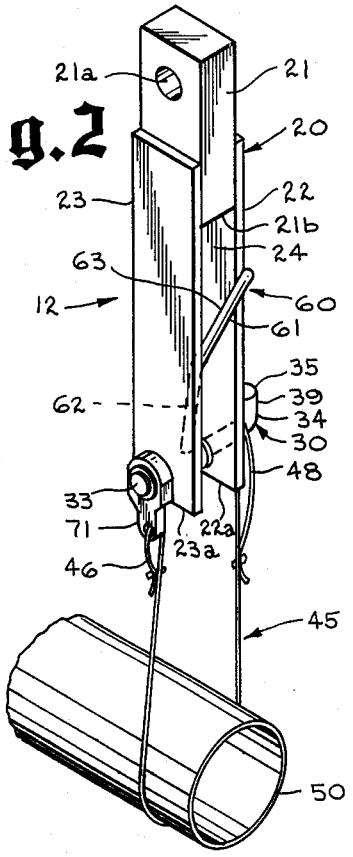
FIG. 2 is a perspective view illustrating a preferred embodiment of the present invention.

Attention is first directed to FIG. 2 where the sling of the present invention is referred to generally by the numeral 12 and includes a support member referred to generally at 20 with a rotatable member referred to generally at 30 carried by and rotatable relative to the support member 20.

Flexible support means referred to generally at 45 are provided for looping about and holding an object such as a pipe or the like as referred to at 50, it being contemplated that any suitable number of slings may be employed as desired for holding and transporting the pipe. Ordinarily, in most instances, at least in use of the present invention in connection with a pickup and pipe laydown machine, two pipe slings have been found ample, one for engaging adjacent the pin end, and one adjacent the box end of a tubular member.

Figure 4:
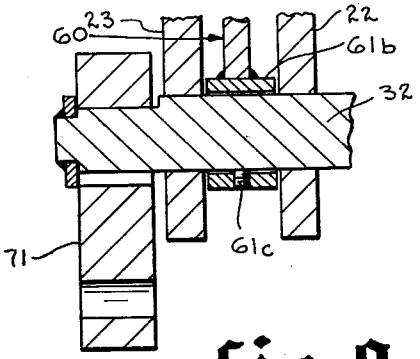
FIG. 4 is an edge view of the invention shown in FIG. 2.
Figure 3:
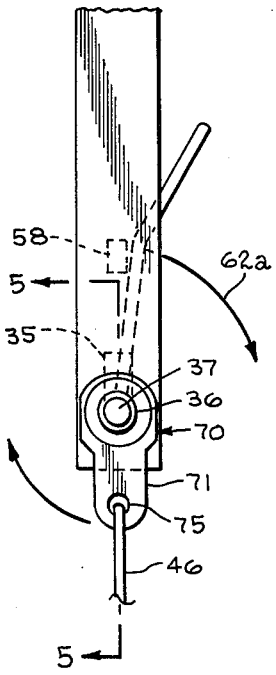
FIG. 3 is a side view of a form of the invention shown in FIG. 2.
Figure 4:
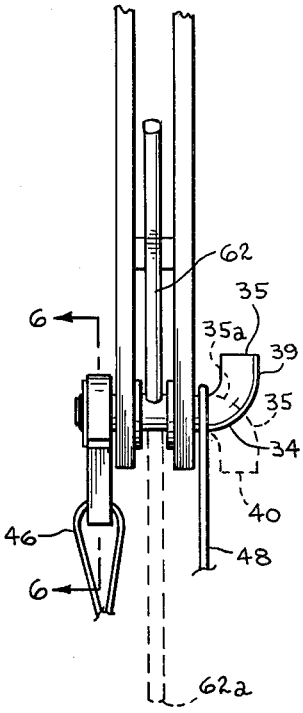

When the flexible support means referred to generally at 45 is holding an object 50 as shown in FIG. 2 of the drawings, the components of the present invention will assume the relationship illustrated in FIGS. 2 – 4.

Actuating means referred to generally at 60 are associated with the rotatable member 30 to rotate the rotatable member to a first position and from the first position illustrated in solid line at 39 in FIGS. 2 and 4 to a second position illustrated in dotted line as illustrated at 40 in FIG. 4 of the drawings. When the actuating means 60 moves from the first position to the second position it shifts from the full line position illustrated at 61 in FIG. 2 to the dotted line position illustrated at **62*a*** in FIG. 4 as will be described in greater detail hereinafter.

Figure 1:
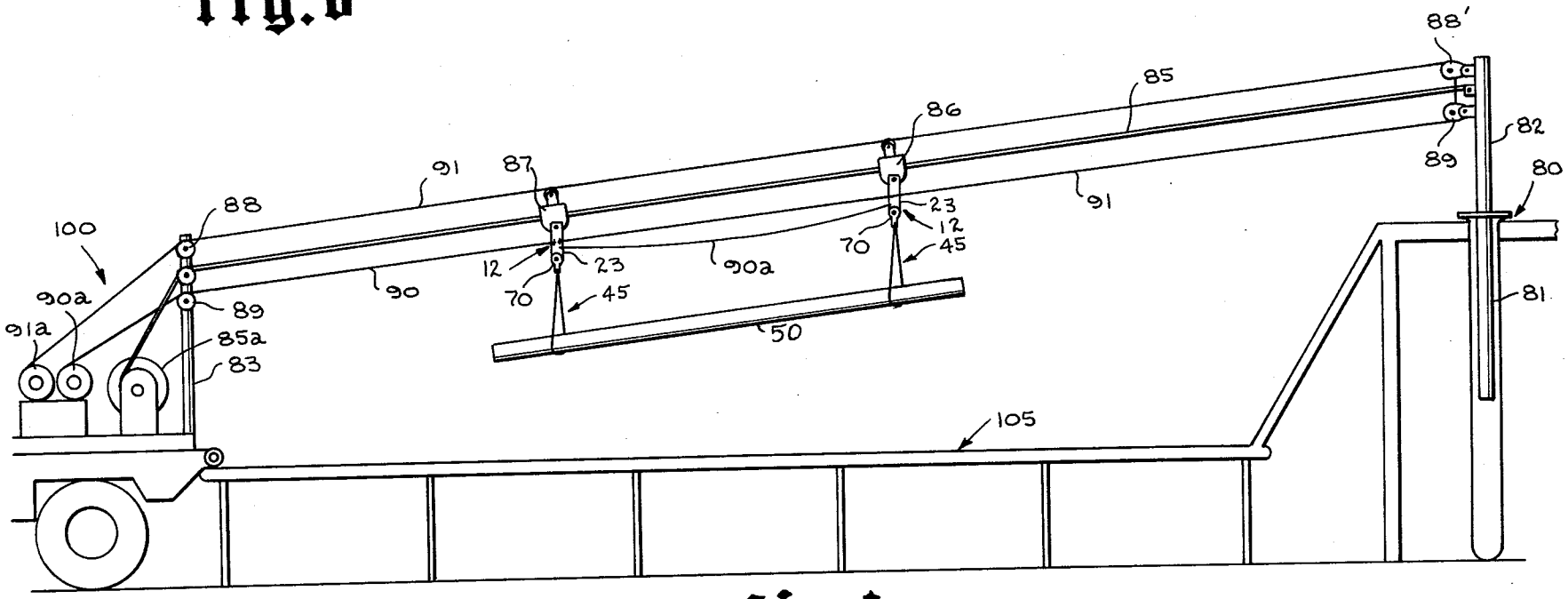
FIG. 1 is a schematic representation of a pipe pickup and laydown machine.

The support member 20 is shown as including a base member 21 having an opening or hole **21*a* therethrough for mounting the support member 20 in any suitable manner as may be desired. The support member is shown in FIG. 1 as being pivotally supported on carriers 86, 87 which are in turn movably supported on cable 85**.

Extensions 22 and 23 are either integrally formed with the base member 21 or they are separately formed and secured to the base member 21 by any suitable means such as welding or the like, which extensions project longitudinally from the base member 21 to provide a space 24 which extends from the end **21*b* of the base member to the ends 22*a* and 23*a* of the extensions 22 and 23**.

As shown in FIG. 2, the base member 21 is rectangular and the extensions 22 and 23 form plate like members extending therefrom as illustrated in the drawings; however, such arrangement may be of any suitable configuration to accomplish the desired results.

Figure 5:
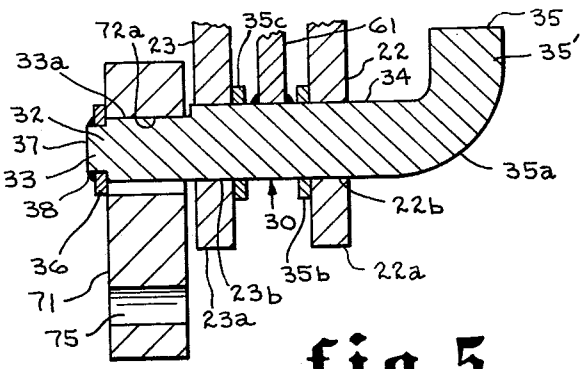
FIG. 5 is a sectional view on the line 5—5 of FIG. 3.

The plate members 22 and 23 also include openings **22*b* and 23*b* respectively therethrough adjacent the lower ends 22*a* and 23*a* as more clearly illustrated in FIG. 5 of the drawings. The rotatable member 30 includes a rod or shaft means 32 having the first or one end 33 which extends or projects laterally from the plate like member 23 and the other end or second end 34 which projects laterally beyond or from the plate like member 22 as shown in the drawings. Also, the other end 34 of the shaft means 32 includes a portion 35' which is bent as illustrated in the drawings relative to the longitudinal axis of the shaft means 32 to project laterally therefrom and form a hook for aiding in retaining an end of the flexible support means 45 engaged therewith when an object is held by the flexible support means 45 as will be described in greater detail hereinafter. Secured to the shaft means 32 are washers 35*b* and 35*c* which are adapted to fit closely adjacent the plate like extensions 22 and 23 respectively as shown in FIGS. 4 and 5 of the drawings. The washers may be split and then positioned on the shaft means 32 after it is positioned through the openings 22*b* and 23*b*, and the split sections then secured together by any suitable means such as welding or the like. If desired, the washers 35*b*, 35*c* may be eliminated and the actuating means 60 provided with an annular enlargement or collar 61*b* surrounding shaft means 32 as shown in FIG. 9. The actuating means 60 may be secured to shaft means 32 by screws 61*c* engaging through enlargement 61*b* and abutting shaft means 32. This aids in retaining the shaft means 32 in position on the support means 20 as it rotates therein and during support, holding and/or transport of an object such as the pipe 50**.

Figure 6:
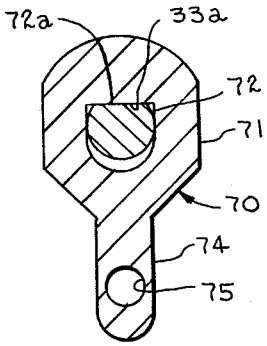
FIG. 6 is a sectional view on the line 6—6 of FIG. 4.

Adjacent, but spaced from the end 33 of the shaft means 32 is a flat surface **33*a* extending on a cord as shown in FIG. 6 to receive the hanger mechanism represented generally by the numeral 70. The hanger mechanism 70 includes a bracket 71 of suitable configuration having an opening 72 therethrough which receives the shaft portion with the flat surface 33*a* thereon adjacent the end 33 of shaft means 32. The opening 72 is provided with a flat surface 72*a* thereon to mate with the flat portion 33*a* adjacent the end of shaft means 32**.

The flat surfaces **33*a* and 72*a* engage when the rotatable shaft means 32 is in the first position and the flexible support means 45 engaged to hold a pipe or object as shown in FIGS. 1–4. Such engagement restrains the rotatable shaft means 32 against moving from the one position to a second position that enables the second end 48 of flexible support means 45 to disengage from the rotatable shaft means 32**.

The bracket 71 depends downwardly below the shaft means 32 in the form of the invention illustrated in the drawings by means of the extension 74 having an opening 75 therein with which the first or one end 46 of the flexible support means 45 may be secured, thus securing such end 46 of the flexible support means 45 with the rotatable member 30. The end 46 of the flexible support member 45 may be positioned through the opening 75 and then secured by a clamp or any suitable means so as to retain it in position on the bracket 71 which is in turn rotatably supported on the rotatable means 30. Any suitable means may be employed to retain the bracket 71 in position on the shaft means 32, and as illustrated a washer 36 is positioned on the annular extension 37 and abuts the end shoulder on annular extension 37 adjacent the bracket 71. The annular extension 37 extends from the flat portion **33*a* adjacent the end 33 of the shaft means 32 and the washer 36 may be secured by any suitable means such as a weld 38 to the shaft means 32. It can be appreciated that if desired the end of the shaft could be threaded and provided with a nut, or a cotter pin could be secured through an opening in the end of the shaft 32 so that the bracket may be removably positioned on the shaft means 32** if desired.

The other end or second end 48 of the flexible support means 45 is provided with a loop as illustrated so that it may be positioned over the hook 35 formed on the other or second end 34 of the shaft means 32 after the flexible support 45 has been looped about an object to be held as illustrated at 50 in FIG. 2 of the drawings. At such time, the shaft means 32 is manually positioned by the actuating means 60 in the full line position shown at 39 of the drawings in the so called first position. The actuating means 60 is in the form of an elongated handle which is secured to the shaft 34 in the space 24 between the extensions 22 and 23 as shown in the drawings as previously described. The handle includes a portion 62 extending upwardly or longitudinally in the space 24 and a portion 63 extending outwardly therefrom as shown in the drawings so that when the sling is holding a pipe or object as illustrated at 50, the handle is generally protected between the plate like extensions 22 and 23, but the portion 63 extends therefrom so that it may be manually grasped to effect rotation of the shaft means 32 when desired. Also the portion 63 forms a counterweight to automatically effect rotation of the shaft means 32 when the object is not held by the flexible support means 45 as will be described.

It will be noted that the hook 35 is formed on the second or other end 34 of the shaft means 32 in a manner so as to provide an arcuate surface 35*a* thereon, so that when the shaft means 30 is rotated to the dotted line position as illustrated at 40 in FIG. 4 of the drawings, the loop 48 will tend to slide off the second or other end of the shaft means 32 by reason of its engagement with the arcuate surface 35*a* as illustrated in FIG. 4 of the drawings.

Figure 7:
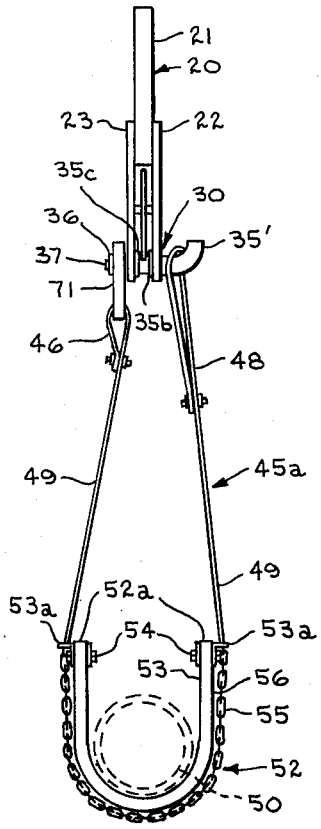
FIG. 7 is an end view of an alternate embodiment of the flexible support means with the sling of the present invention.
Figure 8:
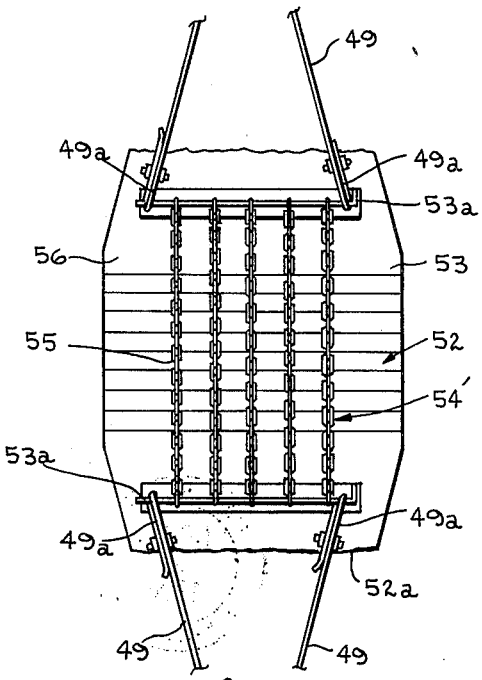
FIG. 8 is a partial plan view of the form of flexible support means as shown in FIG. 7.

An alternate form of flexible support means as illustrated in FIGS. 7 and 8 at 45*a* and includes a generally flexible but substantially nonextensible line or lines 49 having the loops 46 and 48 on the first and second end as previously described with regard to the form of sling illustrated in FIGS. 2–4 inclusive. The flexible line 49 is secured adjacent each end to a cradle means illustrated generally at 52, such cradle means may be in the form of an elastomer member or body 53 which includes reinforcing as referred to generally at 54' to inhibit undue or undesirable stretching or extension of the cradle means 52.

As shown in FIG. 8, the flexible nonextensible lines 49 include a pair of such flexible lines which are tied together adjacent their ends by any suitable means and are provided with the loops 46 and 48 adjacent their ends.

As shown in FIG. 8 of the drawings the ends 49*a* of the flexible line means 49 are secured to suitable bracket means 53*a* which bracket means is in turn secured adjacent the edges 52*a* of the cradle by any suitable means such as the nut and bolt arrangement illustrated at 54. The reinforcing 54' may be in the form of separate chains 55 which are secured at each of their ends to the spaced bracket means 53*a* by any suitable means such as welding or the like, such chains 55 fitting closely adjacent the outer surface 56 of the sheet of elastomer 53 as shown in FIGS. 7 and 8 of the drawings. The cradle means 52 receives the object 50 as shown in dotted line in FIG. 7 and cradles or holds the pipe or other object therein. This may eliminate the use of thread protectors.

As noted previously, the flat engaged surfaces 33*a*, 72*a* tend to restrain the shaft means 32 against rotation away from the first position illustrated in full line at 39 when the flexible support means 45 is looped about and holding or supporting an object 50 as shown in FIG. 2 of the drawings. A stop 58 is positioned between the extensions 22 and 23 and against which the handle abuts when it is moved to the full line position illustrated in FIG. 2 of the drawings. The weight of the object 50 tends to retain the actuating means 60 in this position by reason of the engagements of flat surfaces 33*a* and 72*a* on the rotatable member 32 and hanger means 75 until the handle forming the actuating means is manually grasped and moved toward the direction indicated by arrow 62*a*.

If the handle is not manually rotated, it will retain its position as shown in FIGS. 2–4 until the weight of the object is released from flexible support means 45. When this occurs, the portion 63 causes the handle to automatically rotate, which also rotates shaft 32 and enables the second end 48 of the flexible support 45 to disengage from the second end 34 of shaft means 32.

When the shaft means 32 is rotated about its longitudinal axis by the handle so as to move the shaft means 32 from the first position (at which time it is engaged with the second end 48 of the flexible support means 45 while holding object 50) to the second or other position as illustrated at 40 in FIG. 4, this disengages the flexible support means 45 from the hook on shaft end 34 and thereby disengages the sling from the object 50 being held.

While it is believed that the operation of the present invention is apparent from the foregoing description, attention is directed to FIG. 1 wherein the working area of a drilling rig such as an oil or gas rig is schematically illustrated by the numeral 80. A suitable opening 81 is provided adjacent the working surface for receiving a vertical support 82 therein as shown in the drawings. Suitable means such as a cable 85 extends from a winch and over the pulley on the vertical support 83 to be secured to the vertical support 82 adjacent the rig working area 80.

A suitable drive shaft connects each of the three winches on which each cable 85, 90 and 91 is separately connected as referred to at 100. Suitable drive connections are provided between a power source and each winch which include clutch arrangements so that the winches may be selectively engaged with the drive shaft and powered as desired to reeve the respective cable connected therewith onto the winch. Also, the clutches permit the winches to rotate freely when not connected to the power source. The winches are each provided with a braking arrangement. Thus they may be selectively connected and disconnected to the drive shaft and power source, and the brake means may be selectively applied to the three winches, as desired. Mounted on the main cable 85 are a pair of carriers 86 and 87 which carriers have suitable pulley means to enable movement of the carriers along the cable 85. Other pulleys 88 and 89 are mounted on the vertical standard 82 and on the vertical standard 83. A pull up cable 91 is reeved on one winch 91*a*, passes over the pulleys 88, 88' and 89 on the vertical standards and freely extends through carriage 86 to be connected to the carrier 87 as illustrated in FIG. 1. The pull back cable 90 is reeved on a separate winch 90*a* and passes over pulley 89 as shown to be connected to lower carrier 87. A hobble line 90*a* may be used to connect carriers 86 and 87 together when desired to limit their spacing.

When the cable 91 is wound on the winch 91*a*, the carriers 86 and 87 will move up along the cable 85 from the vertical standard 83 toward the vertical standard 82. When it is desired to move pipe from the rig floor 80 to a pipe rack, the carriers 86, 87 are moved up 85 by the winch 91*a* and the pipe 50 engaged with the slings of the present invention secured to carrier. The winch 91*a* to which cable 91 is connected is then disconnected from the power source and the brake released so the carriers 86 and 87 freely move along with the pipe 50 by gravity from working area 80 downwardly along cable 85. When the pipe 50 is adjacent pipe rack 105, the brake on which 91*a* is applied to stop the descent; the brake on winch 85*a* is then released to slacken or lower main line 85 to enable the pipe 50 to be lowered onto and positioned on pipe rack 105 as desired.

The brake on the winch 91*a* is employed to control the rate of descent of the pipe from the rig floor to the pipe rack. The pull back cable 90 can be disconnected from carrier 87 during the time that pipe is being laid down, that is, moved from the rig to the pipe rack.

When pipe is picked up the brake on winch 85*a* is again released to place slack in main line 85 so carriers 86, 87 and the slings 12 are adjacent the pipe on the pipe rack for securing therewith. The winch 85*a* is then connected to the power source by the clutch and the main cable 85 made taut.

Normally the pipe rack represented at 105 is employed in connection with oil and gas drilling operations upon which a plurality of tubular members are normally positioned prior to moving them to the derrick floor work area 80 for lowering into the well bore. The sling 12 of the present invention is pivotally mounted on each carrier 86, 87 by any suitable means such as a bolt or the like extending through each carrier and through the opening 21*a* in the base member 21.

In use of the present invention, for purposes of illustration, it will be assumed that the carriers 86 and 87 have been lowered adjacent the pipe rack and that a pipe or tubular object as illustrated at 50 is to be engaged and moved from the pipe rack to the rig floor. The free end 48 with the loop therein of the flexible support means 45 is wrapped around the tubular object 50 adjacent the ends thereof as illustrated in the drawings and the end 48 engaged over the hook 35 on the rotatable shaft 32. At such time, the handle means 60 is moved to the full line position of FIGS. 2–4 while the actuating mechanism 100 is manipulated, as previously described so that the object 50 is lifted from the pipe rack 105 by the main line 85 and the carriers 86, 87 including slings 12 with the flexible support means 45 forming part of the sling invention 12 of the present invention.

Due to the weight of the object 50, and the engagement of flat surfaces 33*a* and 72*a* the handle means 60 will be restrained against movement away from the stop means 58 and the sling of the present invention 12 will retain the flexible support means 45 engaged with the pipe 50 until it arrives adjacent the work area 80 on the rig floor. When it is desired to remove the object 50 from engagement with the sling 12 of the present invention, the handle means 60 is rotated in the direction of arrow 62*a* which positions the hook 35 so that the loop 48 may slide off the end 34 of the shaft means 32. Also, if the pipe 50 is set down, or, its weight taken off the flexible means 45, the handle will automatically rotate and this causes shaft means 32 to rotate so that the second end 48 of the flexible support means 45 disengages from the second end 34 of the shaft means.

In effect, the arrangement of the present invention provides a means of not only quickly and readily engaging an object such as a pipe or the like, with a sling but retains the sling engaged therewith unti the shaft means is manually rotated or until the weight of the object is relieved from the sling whereupon the loop 48 disengages from the shaft means 32 to release the sling from the object. When the pipe is being laid down, that is, taken from the work area 80 and put in the pipe rack 105, the present invention is particularly advantageous.

For example, the pipe 50 is moved rapidly from the work area 80, since the winch 91*a* is disconnected from the drive shaft, aand the rate of descent of the pipe along cable 85 is controlled only by the brake on the winch 91*a*. When the pipe is adjacent the pipe rack 105, main cable 85 can be lowered by disconnecting winch 85*a* from the drive shaft and using the brake to control the rate of lowering of cable 85. When the pipe engages the rack 105, the present invention will automatically disengage to enable the pipe 50 to move along pipe rack 105.

The main cable 85 can be elevated by winch 85*a* and carriers 86, 87 moved therealong to work area 80 for engagement with another pipe. In those cases where pipe is being moved by the present invention, and the angle of inclination of cable 85 is not sufficient to provide movement of carriers 86, 87 in a manner desired, the pull back cable 90 may be employed.

The foregoing disclosure and description of the invention are illustrative and explanatory thereof, and various changes in the size, shape, and materials as well as in the details of the illustrated construction may be made without departing from the spirit of the invention.

What is claimed is:

1. A sling for use in holding an object comprising:

a. a support member;

b. a rotatable member carried by and rotatable relative to said support member;

c. said rotatable member having first and second end which extend laterally from said support member;

d. flexible support means for looping about the object to be held and having one end secured with said first end of said rotatable member and a second end for releasably engaging with said second end of said rotatable member;

e. said second end of said rotatable member including retaining means to aid in retaining said second end of said flexible support means engaged therewith when said rotatable member is in one position while said flexible support means holds the object;

f. actuating means associated with said rotatable member to rotate said rotatable member to a second position for disengagement of said second end of said flexible support means from said second end of said rotatable member to release the sling from its hold on the object;

g. restraining means to restrain said rotatable member against rotation from said one position while said flexible support means holds the object, said restraining means including:

1. a hanger means with which said one end of said flexible support means is secured;

2. said hanger means having an opening therein for receiving said first end of said rotatable member with a portion of such opening having a flat surface; and 3. said first end of said rotatable member having a longitudinally extending flat surface which is engagable with the flat surface in the opening in said hanger means when said flexible support means holds the object whereby rotation of said rotatable member from said one position is restrained while said flexible support means holds the object.

2. A sling for use in holding an object comprising:

a. a support member;

b. said support member including:

1. a base member;

2. extension formed on said base member and projecting longitudinally therefrom to provide a space therebetween;

c. shaft means rotatably carried by and extending through said extensions;

d. said shaft means having a first end which projects laterally from one of said extensions and a second end which projects laterally from another of said extensions;

e. flexible support means for looping about the object to be held and having one end secured with said first end of said shaft means and a second end for releasably engaging with said second end of said shaft means;

f. said shaft means second end defining a hook to aid in retaining said second end of said flexible support means engaged therewith when said shaft means is in one position while said flexible support means holds the object;

g. actuating means associated with said shaft means to rotate said shaft means to a second position for disengagement of said second end of said flexible support means from said second end of said shaft means to release the sling from its hold on the object; and h. retaining means to aid in retaining said shaft means in said one position while said flexible support holds the object, said retaining means including:

1. hanger means depending from said first end of said shaft means and secured to said one end of said flexible support;

2. said hanger means being supported on said shaft means; and 3. said first end of said shaft means and said hanger means having flat surfaces coengagable when said shaft means is in said one position to restrain said shaft means against rotation from said one position.

3. A sling for use in holding an object comprising:

a. a support member;

b. a rotatable member carried by and rotatable relative to said support member;

c. said rotatable member having first and second ends which extend laterally from said support member;

d. flexible support means for looping about the object to be held and having one end secured with said first end of said rotatable member and a second end for releasably engaging with said second end of said rotatable member;

e. said second end of said rotatable member including retaining means to aid in retaining said second end of said flexible support means engaged therewith when said rotatable member is in one position while said flexible support means holds the object;

f. actuating means associated with said rotatable member to rotate said rotatable member to a second position for disengagement of said second end of said flexible support means from said second end of said rotatable member to release the sling from its hold on the object;

g. restraining means to restrain said rotatable member against rotation from said one position while said flexible support means holds the object; and h. said actuating means being constructed and arranged so that when the object is not held by said flexible support means said rotatable member automatically rotates from said one position to said second position for disengagement of said second end of said flexible support means from said rotatable member.

* * * * *